US007658600B2

(12) United States Patent
Fujita et al.

(10) Patent No.: US 7,658,600 B2
(45) Date of Patent: Feb. 9, 2010

(54) SCROLL COMPRESSOR WITH THRUSTPLATE PEELING PREVENTION

(75) Inventors: Katsuhiro Fujita, Kiyosu (JP); Kazuhide Watanabe, Kiyosu (JP); Takayuki Kuwahara, Kiyosu (JP); Tomohisa Moro, Kiyosu (JP); Makoto Takeuchi, Nagoya (JP); Hiroshi Yamazaki, Nagoya (JP); Tetsuzou Ukai, Kiyosu (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 149 days.

(21) Appl. No.: 11/595,975

(22) Filed: Nov. 13, 2006

(65) Prior Publication Data

US 2007/0292294 A1 Dec. 20, 2007

(30) Foreign Application Priority Data

Jun. 14, 2006 (JP) ..... 2006-164678

(51) Int. Cl.
*F01C 21/00* (2006.01)
*F03C 2/00* (2006.01)

(52) U.S. Cl. ..... 418/178; 418/55.1; 418/55.5; 418/57

(58) Field of Classification Search ..... 418/55.1–55.6, 418/57, 178
See application file for complete search history.

(56) References Cited

U.S. PATENT DOCUMENTS

| | | | | |
|---|---|---|---|---|
| 4,522,575 | A * | 6/1985 | Tischer et al. | 418/55.5 |
| 4,549,862 | A * | 10/1985 | Stich et al. | 418/178 |
| 5,727,935 | A * | 3/1998 | Shigeoka et al. | 418/55.5 |
| 2006/0194021 | A1 | 8/2006 | Takeda et al. | |

FOREIGN PATENT DOCUMENTS

| | | | |
|---|---|---|---|
| EP | 0697522 | A1 | 2/1996 |
| JP | 08338377 | A * | 12/1996 |
| JP | 10122165 | A * | 5/1998 |
| JP | 11336676 | A * | 12/1999 |
| JP | 2000220582 | A * | 8/2000 |
| JP | 2001132665 | A * | 5/2001 |
| JP | 2002195180 | A * | 7/2002 |
| JP | 3364016 | B2 | 10/2002 |
| JP | 2005201367 | A * | 7/2005 |
| JP | 2005-325842 | A | 11/2005 |
| JP | 2005315167 | A * | 11/2005 |

* cited by examiner

*Primary Examiner*—Theresa Trieu
(74) *Attorney, Agent, or Firm*—Birch, Stewart, Kolasch & Birch, LLP

(57) ABSTRACT

There is provided a scroll compressor in which reliability and durability is increased by preventing peeling of a coating layer applied to a thrust plate, to maintain a desired level of lubrication for a long period of time. The scroll compressor has a thrust plate, a coating which is applied to a surface of the thrust plate, a housing having a thrust bearing face to which the thrust plate is attached, an orbiting scroll member having a slide face which is supported by the thrust plate and which orbits while sliding, and a peeling prevention part which reduces a sliding pressure acting on an edge portion of the thrust plate from the slide face.

4 Claims, 4 Drawing Sheets

SCROLL COMPRESSOR WITH THRUSTPLATE PEELING PREVENTION

BACKGROUND OF THE INVENTION

1. Field of the Invention

The present invention relates to a scroll compressor used to compress refrigerant gas and the like.

This application is based on Japanese Patent Application No. 2006-164678, the content of which is incorporated herein by reference.

2. Description of the Related Art

Heretofore a scroll compressor is known as a compressor which compresses a fluid gas such as refrigerant gas or the like.

In this kind of scroll compressor a thrust slide bearing is provided which slides against an outer face of an end plate formed by a slide face of an orbiting scroll member, to support a thrust load acting on the orbiting scroll member. This thrust slide bearing is a thrust plate formed from a ring-shaped thin steel plate with a coating film of solid lubricant applied to the slide face, and is attached to a thrust bearing face formed on the housing side. (For example, see Publication of Japanese Patent No. 3364016, FIG. 1).

Furthermore, a fluid machine has been proposed in which a resin coating principally composed of fluororesin and polyamideimide resin is formed on one or both sides of a slide face of a structural member. That is, by specifying the principal components and component ratio combined to form a film with a fluororesin base, formation of a highly reliable resin film in which cracking and peeling do not occur over a long period of time becomes possible. (For example, see Japanese Unexamined Patent Application, Publication No. 2005-325842, FIG. 2).

Incidentally, in a thrust plate (thrust slide bearing) which supports the slide face of an orbiting scroll member, when a coating of a fluororesin such as PTFE is applied to the steel plate with the aim of improving lubrication, peeling of the coating becomes a problem. Hereunder the problem of peeling will be specifically explained with reference to the drawings.

In FIG. 5, reference numeral 27 denotes an orbiting scroll member, which is disposed inside a front housing 5 constituting a low pressure side. In the orbiting scroll member 27, a rear face of an end plate 27A forms a slide face 61, and this is supported and slides on a thrust plate 51 which is fixedly installed on a thrust bearing face 5B of the front housing 5.

As shown in FIG. 6A and FIG. 6B for example, the thrust plate 51 is one where a coating layer 51*b* of fluororesin or the like is formed on the surface of a ring-shaped thin steel plate 51*a*. This coating layer 51*b* receives a repetitive thrust load from the sliding orbiting scroll member 27. Therefore, both corner portions in particular are in danger of peeling off. That is, both corner portions of the thin steel plate 5*a* are parts where it is difficult to form the coating layer 51*b* to a satisfactory uniformity. For example, as shown in FIG. 7A, because the coating layer 51*b* does not adhere easily, separation occurs at the corners, or as shown in FIG. 7B, it is easy for the coating layer 51*b* to become too thick when the amount of adhesion is increased in order to prevent separation.

From this background, in a scroll compressor, it is desirable to prevent peeling of the coating layer 51*b* applied to the thrust plate 51, to thereby maintain a desired level of lubrication over a long period of time and thus increase reliability and durability.

BRIEF SUMMARY OF THE INVENTION

The present invention takes into consideration the above circumstance, with an object of providing a scroll compressor in which reliability and durability is increased by preventing peeling of the coating layer applied to the thrust plate, to maintain a desired level of lubrication for a long period of time.

The present invention adopts the following means in order to solve the above problem.

A scroll compressor according to the present invention is a scroll compressor comprising a thrust plate, a coating which is applied to a surface of the thrust plate, a housing having a thrust bearing face to which the thrust plate is attached, an orbiting scroll member having a slide face which is supported by the thrust plate and which orbits while sliding, and a peeling prevention part which reduces a sliding pressure acting on a thrust plate edge portion from the slide face.

According to such a scroll compressor, because a peeling prevention part is provided which reduces the sliding pressure acting on the thrust plate edge portion from the slide face, then in the thrust plate edge portion where formation of a satisfactorily uniform coating layer is difficult, peeling of the coating layer can be prevented due to a reduction in the repeatedly acting sliding pressure.

In the above aspect of the invention preferably the peeling prevention part is a slide prohibited area established on an edge portion of the thrust plate. As a result, the sliding pressure does not act directly on the thrust plate edge portion where formation of a satisfactorily uniform coating layer is difficult. That is, this peeling prevention part can reduce the sliding pressure acting on the thrust plate edge portion to zero.

In the above aspect of the invention, preferably the peeling prevention part is a flexible area established on an edge portion of the thrust plate. As a result, when a sliding pressure acts on the thrust plate edge portion where formation of a satisfactorily uniform coating layer is difficult, the thrust plate can flex and thus absorb the sliding pressure.

The flexible area in this case is preferably one which supports the thrust plate by a curved or inclined face, and where a space formed between the thrust plate at both edges changes gradually.

In the above aspect of the invention preferably the peeling prevention part is a curved face or bevelled edge formed on an edge portion of the slide face. As a result, in the thrust plate edge portion where formation of a satisfactorily uniform coating layer is difficult, a space is formed between the slide face and the thrust plate. Therefore sliding pressure does not act directly. That is, this peeling prevention part can reduce the sliding pressure acting on the thrust plate edge portion to zero.

Also, because the coating layer becomes difficult to peel off, it is possible to make the coating layer thinner.

According to the invention described above, by providing the peeling prevention part which can reduce the sliding pressure acting on the thrust plate edge portion from the slide face, then in the thrust plate edge portion where formation of a satisfactorily uniform coating layer is difficult, it becomes possible to reduce the repeatedly acting sliding pressure. Therefore, because peeling of the coating layer attributable to the sliding of the orbiting scroll member is prevented, and a desired level of lubrication can be maintained over a long period of time, a remarkable effect is obtained where reliability and durability of the scroll compressor is improved.

DETAILED DESCRIPTION OF THE INVENTION

Hereunder, embodiments of a fluid machine according to the present invention will be described with reference to the drawings.

Figures 1A, 1B:
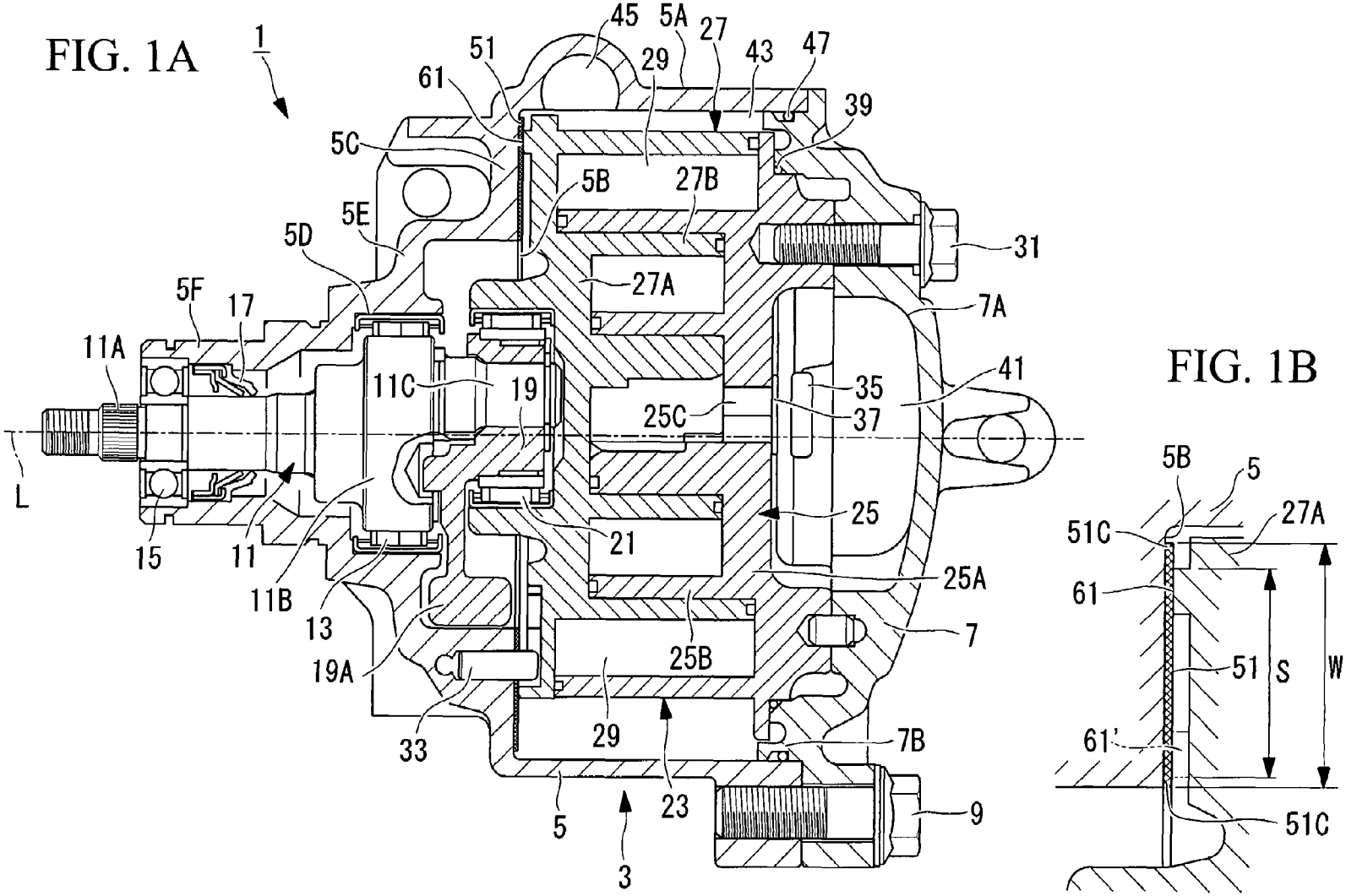
FIG. 1A is a cross-section of an overall structural example showing an embodiment of a scroll compressor according to the present invention.
FIG. 1B is an enlarged cross-section view of a main part showing a first embodiment of a peeling prevention part.

FIG. 1A is a cross-section of a scroll compressor 1 used to compress refrigerant gas or the like. This scroll compressor 1 is a horizontal type applicable to refrigeration units through to air conditioning units, particularly refrigeration units and air conditioning units for use in vehicles, and has a housing 3 which constitutes the approximate outer shape, and which houses a compressor within an internal space. The housing 3 is equipped with a front housing 5 of a low pressure side housing and a rear housing 7 of a high pressure side housing. These are secured together in a condition with flanges provided on each of the housings integrally clamped by means of bolts 9.

Inside the front housing 5, a crankshaft 11 is supported so as to be freely rotatable about an axis L via a main bearing 13 and a sub bearing 15. One end of the crankshaft 11 (on the left in the figure) is a small diameter shaft portion 11A. This small diameter shaft portion 11A is inserted through the front housing 5 and protrudes to the left in FIG. 1A. The protruding portion of the small diameter shaft portion 11A is provided with a solenoid clutch, or a pulley or the like (omitted from figure), similar to known technology, which receives a driving force, and power is transmitted from a driving source such as an engine (omitted from figure) via a V belt and so on.

Between the main bearing 13 and the sub bearing 15, a mechanical seal (lip seal) 17 is disposed, so that the inside of the housing 3 is airtight and sealed from the atmosphere.

The other end of the crankshaft 11 (on the right in the figure) is provided with a large diameter shaft portion 11B. Furthermore, on this large diameter shaft portion 11B is integrally provided an eccentric pin 11C in a state where it is biased by a predetermined dimension from the axis L of the crankshaft 11. The large diameter shaft portion 11B and the above-mentioned small diameter shaft portion 11A are each supported in a freely rotatable manner by the front housing 5 via the main bearing 13 and the sub bearing 15. The eccentric pin 11C is connected to an orbiting scroll member 27 via a drive bush 19 and a drive bearing 21, and by rotating the crankshaft 11, the orbiting scroll member 27 is orbitally driven.

A balance weight 19A is integrally formed on the drive bush 19 in order to cancel out the load inbalance which occurs due to the orbital drive of the orbiting scroll member 27, and orbits together with the orbiting drive of the orbiting scroll member 27.

Furthermore, a fixed scroll member 25 and the orbiting scroll member 27 constituting a scroll compression mechanism 23 are incorporated as a pair inside the housing 3. The fixed scroll member 25 comprises an end plate 25A and a spiral-shaped wrap 25B provided upright on the end plate 25A, while the orbiting scroll member 27 comprises an end plate 27A and a spiral-shaped wrap 27B provided upright on the end plate 27A.

The fixed scroll member 25 and the orbiting scroll member 27 pair is incorporated in an intermeshed state with their respective centers separated by the radius of gyration, and the spiral-shaped wraps 25B and 27B 180° out of phase. As a result, between both of the scroll members 25 and 27, a pair of compression spaces 29 which are limited by the end plates 25A and 27A and the spiral-shaped wraps 25B and 27B are formed symmetrical with respect to the centres of the scrolls. The fixed scroll member 25 is fixedly installed on the inner face of the rear housing 7 by bolts 31. In the orbiting scroll member 27, the eccentric pin 11C provided on one end of the aforementioned crankshaft 11 is connected to a boss part provided on the rear face of the end plate 27A, so as to orbitally drive the orbiting scroll member 27.

Furthermore, regarding the orbiting scroll member 27, a thrust plate 51 is fixedly installed on a thrust bearing face 5B formed on the front housing 5, and a projecting slide face 61 provided on the rear face of the end plate 27A is supported in a contacted state against this thrust plate 51. The orbiting scroll member 27 is configured so that it is orbitally driven with respect to the fixed scroll member 25 while rotation is inhibited by means of a rotation inhibiting mechanism 33 such as a pin ring or an Oldham ring or the like interposed between the thrust plate 51 of the thrust bearing face 5B and the slide face 61 of the orbiting scroll member 27.

Figure 6A:
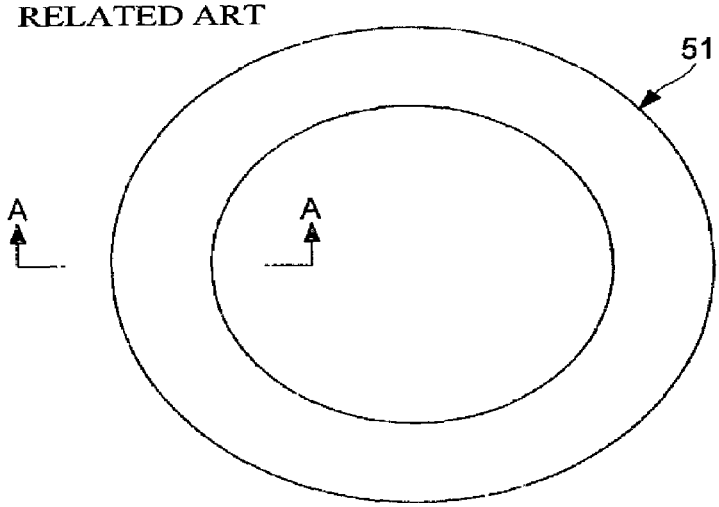
FIG. 6A RELATED ART
FIG. 6A is a plan view showing a structural example of a thrust plate.
Figure 6B:
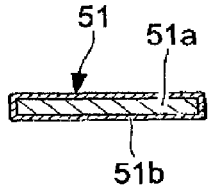
FIG. 6B RELATED ART
FIG. 6B is a cross-section through A-A of FIG. 6A.
Figure 7A:
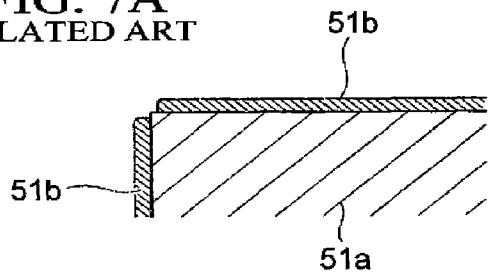
FIG. 7A RELATED ART
FIG. 7A is a diagram showing separation of a coating layer on a corner portion, as an example of a peeling problem that occurs in the coating layer of the thrust plate corner portion.
Figure 7B:
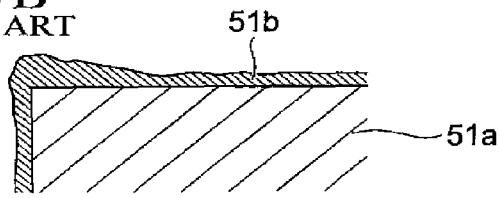
FIG. 7B RELATED ART
FIG. 7B is a diagram showing thickening of the coating layer, as an example of a peeling problem that occurs in the coating layer of the thrust plate corner portion.

As shown in FIG. 6A and FIG. 6B, the thrust plate 51 is a member formed with a coating layer 51*b* such as fluororesin or the like on the surface of a ring shaped thin steel plate 51*a*, and receives the sliding pressure caused mainly by the gas compression reaction force, from the slide face 61 of the orbiting scroll member 27 when the scroll compressor 1 is operating.

A discharge port 25C for discharging the compressed refrigerant gas, is formed in the centre of the end plate 25A of the fixed scroll member 25. The discharge port 25C is provided with a discharge reed valve 37 attached to the end plate 25A via a retainer 35. Moreover, a sealing member 39 such as an O-ring or the like is interposed on the rear face side of the end plate 25A of the fixed scroll member 25 so as to seal the inner face of the rear housing 7, forming a discharge chamber 41 with the rear housing 7 which is divided off from the space inside the housing 3. As a result, the space inside the housing 3 excluding the discharge chamber 41 is configured so as to function as a suction chamber 43. Refrigerant gas returning from the refrigerating cycle is drawn into the suction chamber 43 via a suction inlet 45 which is provided in the front housing 5, and after passing through this suction chamber 43, the refrigerant gas is drawn into a compression space 29 formed between the fixed scroll member 25 and the orbiting scroll member 27.

A sealing member 47 such as an O-ring is interposed between the connecting faces of the front housing 5 and the rear housing 7, and the suction chamber 43 formed inside the housing 3 is airtight and sealed from the atmosphere.

A scroll compression mechanism 23 is housed within the front housing 5. This front housing 5 is formed in a funnel shape with the diameter reducing stepwise, and is provided with; a large diameter trunk part 5A which accommodates the fixed scroll member 25 and the orbiting scroll member 27, a thrust receiving part 5C which is continuous from this trunk part 5A with diameter reducing in the radial direction, for forming the thrust bearing face 5B, an intermediate diameter bearing support 5E which is continuous from the thrust receiving part 5C with the diameter reduced further, for forming a bearing container 5D for containing the main bearing 13, and a small diameter boss part 5F which is continuous from the bearing support 5E for installing the sub bearing 15 and the mechanical seal 17.

The rear housing 7 is formed in a bowl shape, and is provided with a concave part 7A for forming the discharge chamber 41, and a spigot part 7B fitted into the open end of the trunk part 5A of the front housing 5. The aforementioned sealing material 47 is interposed on the spigot part 7B. This rear housing 7 is connected so as to cover one of the open ends of the trunk part 5A of the front housing 5, and is secured in a condition with both flange parts of the front housing 5 and the rear housing 7 integrally fastened to each other by the bolts 9.

The scroll compressor configured as described above operates as described below.

A rotary driving force is transmitted from the external drive source (omitted from figure) via the pulley or solenoid clutch or the like to the crankshaft 11. When the crankshaft 11 rotates, the orbiting scroll member 27, which is connected to the eccentric pin 11C of the crankshaft 11 via the drive bush 19 and the drive bearing 21, is orbitally driven with respect to the fixed scroll member 25 while rotation is inhibited by means of the rotation inhibiting mechanism 33. As a result, the refrigerant gas inside the suction chamber 43 is drawn into the compression space 29 which is formed in the outermost radial direction. After the compression space 29 has reached a specified angle of rotation and suction is cut off, it is moved to the central side while its capacity is decreased. During this time the refrigerant gas is compressed to a high pressure, and when the compression space 29 reaches a position communicating with the discharge port 25C, the discharge reed valve 37 is pushed open, discharging the compressed gas into the discharge chamber 41. Then after passing through the discharge chamber 41 the compressed gas is further discharged outside the scroll compressor 1.

The scroll compressor 1 as described above, wherein the thrust plate 51 formed by a coating layer 51*b* of fluororesin or the like applied to its surface, is attached to the thrust bearing face 5B of the front housing 5, and the slide face 61 of the orbiting scroll member 27 is supported on the thrust plate 51 to orbit while sliding, is provided with a peeling prevention part in order to reduce sliding pressure, with the object of preventing peeling of the coating layer that is caused by the end plate 27A of the orbiting scroll member 27 repeatedly contacting an edge portion 51C of the thrust plate 51, and also by receiving the sliding pressure caused by the compression reaction force of the gas acting on the orbiting scroll member 27.

Hereunder a first embodiment of the peeling prevention part will be specifically described with reference to FIG. 1B.

The peeling prevention part in the figure is one where a slide prohibited area is established on the edge portion 51C of the thrust plate 51. That is, by operating the scroll compressor 1, the orbiting scroll member 27 is orbitally driven to revolve around the fixed scroll member 25 while its rotation is inhibited, and due to the eccentric gyration about the axis L, the orbiting scroll member 27 moves in a range from the outermost slide face 61 to the innermost slide face 61'. Accordingly, in the description below, a slide range S through which the slide face 61 moves while in contact with the thrust plate 51, extends from the outer peripheral face of the slide face 61 when moved to the outermost side to the inner peripheral face of the slide face 61' when moved to the innermost side.

Consequently in the sliding part of the orbiting scroll end plate rear face, as a structure where one part of the end plate 27A touches, by setting the slide range S so that it is smaller than the width W of the thrust plate 51, and in the centre of the width W excluding both edge portions of the thrust plate 51*a*, a slide prohibited area can be formed on both sides of the slide range S where the sliding part 61 does not slide.

Because this slide prohibited area is an area where the sliding part 61 never slides, the sliding pressure does not act directly on the edge portion 51C of the thrust plate 51 where formation of a satisfactorily uniform coating layer 51*b* is difficult. Accordingly, the peeling prevention part provided with a slide prohibited area can reduce the sliding pressure acting on the edge portion 51C of the thrust plate 51 to zero. Therefore it is possible to prevent peeling of the coating layer 51*b* which is caused as a result of the sliding pressure acting repetitively.

It is possible to adjust the above slide range S by configuring the rear face of the end portion 27A of the orbiting scroll member 27 with part slightly removed. Moreover, with regard to the slide face 61 of the directly sliding orbiting scroll member 27, needless to say it is preferable for the edge portion in the slide range S to be rounded.

Figure 2:
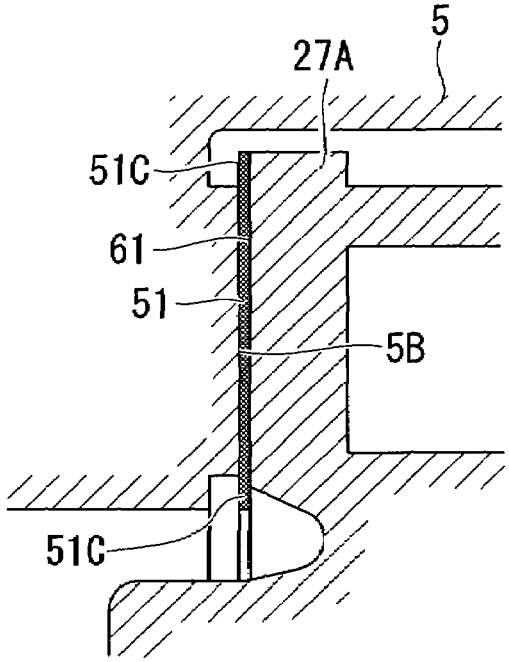
FIG. 2 is an enlarged cross-section view of a main part showing a second embodiment of a peeling prevention part.

Next, a second embodiment of the above peeling prevention part will be described with reference to FIG. 2.

This peeling prevention part is one where a flexible area is established on the edge portion 51C of the thrust plate 51. This flexible area is a cantilevered part provided on both sides of the thrust plate 51, and for example because there is no flat support of the thrust bearing face 5B, the sliding pressure received from the slide face 61 can be flexibly absorbed. That is, when a sliding pressure acts in the flexible area of the thrust plate edge portion 51C where formation of a satisfactorily uniform coating layer 51*a* is difficult, the cantilevered edge portions 51C of the thrust plate 51 are able to absorb the sliding pressure flexibly. Therefore it becomes possible to prevent peeling of the coating layer 51*b* caused as a result of the repeatedly acting sliding pressure.

Figure 3:
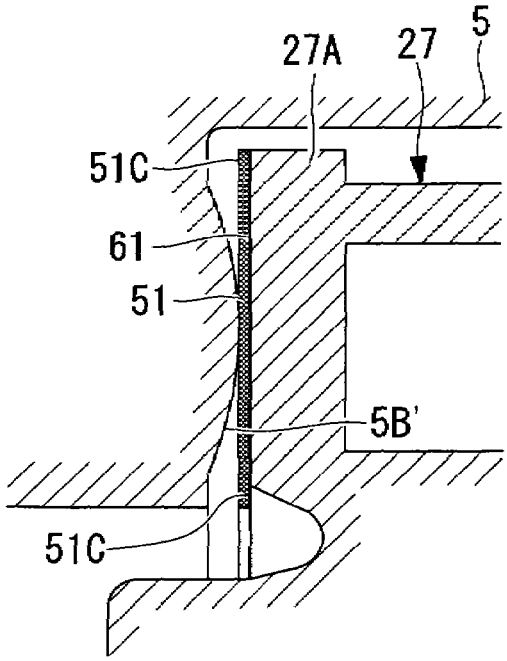
FIG. 3 is an enlarged cross-section view of a main part showing a modified example of the second embodiment shown in FIG. 2.

Incidentally, in the flexible area described above, rather than making the flat thrust bearing face 5B the support face, for example as in the modified example shown in FIG. 3, it is preferable to make a thrust bearing face 5B' in which a space formed between the thrust plate 51 Changes gradually, such as a curved or inclined face where the space formed between the thrust plate 51 is greater at both edge portions, the support face. That is, as the space gradually changes, the flexibility of the thrust plate 51 also changes gradually, thereby enabling a localised concentration of stress to be avoided. Accordingly, a thrust plate 51 which flexibly receives the repetitive sliding pressure caused by the orbital motion of the orbiting scroll member 27 has improved durability due to a modification of the gradual shape change.

Figure 4:
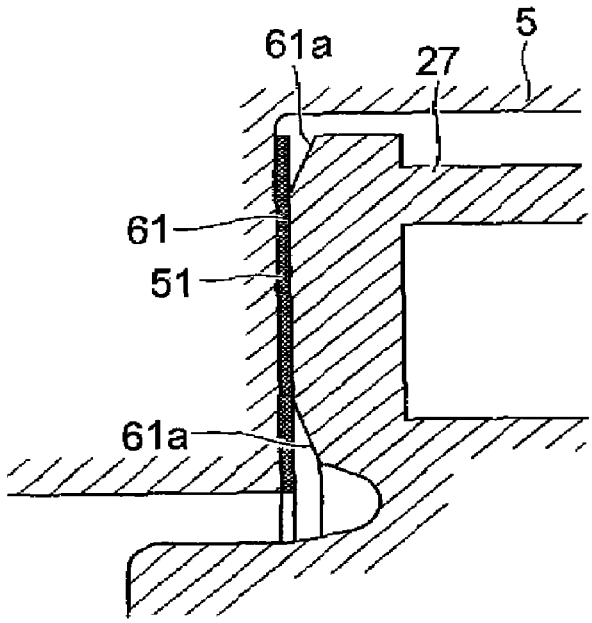
FIG. 4 is an enlarged cross-section view of a main part showing a third embodiment of a peeling prevention part.
Figure 5:
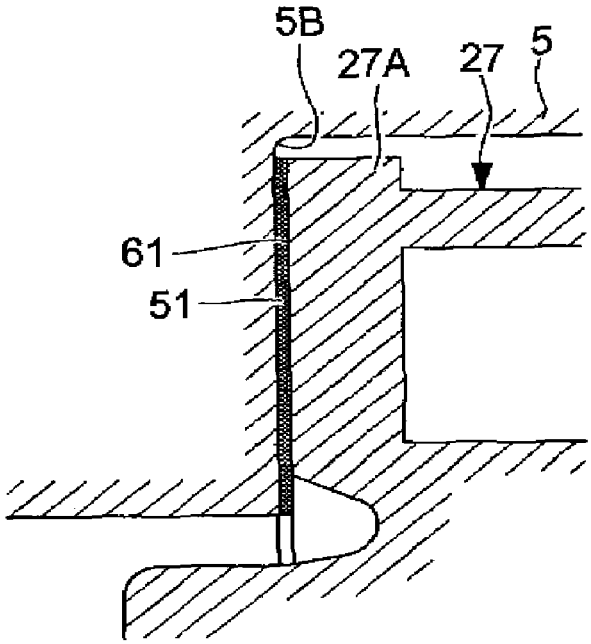
FIG. 5 RELATED ART
FIG. 5 is an enlarged cross-section view of a main part showing a conventional structure of a thrust plate and a sliding part.

Finally, a third embodiment of the above peeling prevention part will be described with reference to FIG. 4.

This peeling prevention part is a pocket forming part 61*a* due to a curved face or bevelled edge formed on both edge portions of the slide face 61. That is, in a slide face 61 which is supported by and slides on a thrust plate 51 fixedly supported on a flat thrust bearing face 5B, a gradually changing space is formed between both edge portions of the slide face 61 and the thrust plate 51, due to formation of a curved face or bevelled edge on either both edge portions, or on either one of the inner or outer peripheries. Accordingly, with respect to the thrust plate edge portion 51C where formation of a satisfactorily uniform coating layer 51*a* is difficult, there is no direct sliding pressure acting from the slide face 61 on the thrust plate 51, and the sliding pressure acting on the thrust plate edge portion 51C can be reduced to zero.

With reference to the size of the thrust plate 51, in the case where the thrust plate 51 is larger than the trajectory of the orbiting scroll, in the first place, it is possible to establish the thrust plate outer diameter edge part so that it does not slide against the end plate 27A of the orbiting scroll member 27. Therefore the problem of the coating layer 51*b* peeling from the plate outer diameter edge part is not encountered, but as far as the inner diameter edge part is concerned the invention of this application is effective. However in that case, since the size of the thrust plate 51 is unnecessarily increased, this produces the disadvantage that the entire outer diameter of the scroll compressor unit becomes too large. Because of this, the present invention is more suitable when the thrust plate is established at a size smaller than the trajectory of the orbiting scroll, and by making the outer diameter of the scroll compressor unit smaller, also has the advantage of maintaining reliability.

Incidentally, because the thickness of the thrust plate 51 coating film is uneven, it was necessary to finely adjust the scroll tip space of the scroll compression mechanism 23 by means of a shim (not shown in figure). Specifically, during the assembly process of the scroll compressor 1, a thin plate-shaped dimension adjusting shim was installed between the front housing 5 and the rear housing 7 in order to finely adjust the space between the orbiting scroll member 27 and the fixed scroll member 25.

However, by adopting the present invention as described above, because the coating layer 51*b* becomes difficult to peel off, thereby increasing reliability, it is possible to make the film thinner. Accordingly, if for example the thrust plate 51 is established as described below, it becomes possible to eliminate the shim.

That is, the plate thickness of the thin steel plate 51*a* is established at less than 0.9 mm, and the thickness of the coating layer 51*b* is established at less than 20 μm. The tolerance permitted in this case is; ±0.005 mm for a thin steel plate 51*a* with a plate thickness between 0.7 mm and 0.9 mm, and ±0.003 mm for a coating layer 51*b* with a thickness less than 20 μm. Therefore application of a surface treatment of the coating layer 51*b* on the thin steel plate 51*a* of the thrust plate 51 is sufficient, and it is possible to eliminate the shim. In other words, the thrust plate 51 enables adjustment of the scroll tip space.

In this way, according to the present invention described above, by providing the peeling prevention part which can reduce the sliding pressure acting on the edge portion 51C of the thrust plate 51 from the slide face 61, it is possible to reduce the repeatedly applied sliding pressure on the edge portion 51C of the thrust plate 51 where formation of a satisfactorily uniform coating layer 51*b* is difficult. Therefore, peeling of the coating layer 51*b* caused by sliding of the orbiting scroll member 27 is prevented, and a desired level of lubrication can be maintained over a long period of time. Hence a remarkable effect is obtained where reliability and durability of the scroll compressor 1 is improved.

The present invention is not limited to the above embodiments, and other modifications are possible within a scope which does not depart from the gist of the present invention.

What is claimed is:

1. A scroll compressor comprising:

a thrust plate, a coating which is applied to a surface of said thrust plate, a housing having a thrust bearing face to which said thrust plate is fixedly attached, an orbiting scroll member having a slide face which is supported by said thrust plate and which orbits while sliding, and a peeling prevention part which reduces a sliding pressure acting on a thrust plate edge portion from said slide face, wherein said peeling prevention part is a flexible area established on an edge portion of said thrust plate.

2. A scroll compressor comprising:

a thrust plate, a coating which is applied to a surface of said thrust plate, a housing having a thrust bearing face to which said thrust plate is fixedly attached, an orbiting scroll member having a slide face which is supported by said thrust plate and which orbits while sliding, and a peeling prevention part which reduces a sliding pressure acting on a thrust plate edge portion from said slide face, wherein said peeling prevention part is a curved face or beveled edge formed on an edge portion of said slide face.

3. A scroll compressor comprising:

a thrust plate having a thrust plate surface extending between two thrust plate edge portions forming peripheral edges of the thrust plate;

a coating applied to the thrust plate, the coating covering at least all of the plate surface including the two thrust plate edge portions;

a housing having a thrust bearing face to which the thrust plate is fixedly attached, an orbiting scroll member having a slide face which is in sliding engagement with at least part of said thrust plate surface extending between the two thrust plate edge portions means for orbiting the orbiting scroll member to cause the slide face to slide relative to the thrust plate surface of the thrust plate, and a peeling prevention means for reducing a sliding pressure acting on at least one of the thrust plate edge portions for preventing peeling of the coating applied to the at least one of the thrust plate edge portions, wherein the peeling prevention means includes means for providing flexible area of the thrust plate at the at least one of the thrust plate edge portions.

4. A scroll compressor comprising:

a thrust plate having a thrust plate surface extending between two thrust plate portions forming peripheral edges of the thrust plate;

a coating applied to the thrust plate, the coating covering at least all of the plate surface including the two thrust plate edge portions;

a housing having a thrust bearing face to which the thrust plate is fixedly attached, an orbiting scroll member having a slide face which is in sliding engagement with at least part of said thrust plate surface extending between the two thrust plate edge portions;

means for orbiting the orbiting scroll member to cause the slide face to slide relative to the thrust plate surface of the thrust plate, and a peeling prevention means for reducing a sliding pressure acting on at least one of the thrust plate edge portions for preventing peeling of the coating applied to the at least one of the thrust plate edge portions, wherein the peeling prevention means includes a curved face portion or beveled edge portion formed on a peripheral side edge portion of the said slide face.

* * * * *